United States Patent [19]

Collin et al.

[11] 4,164,266

[45] Aug. 14, 1979

[54] EXHAUST GAS MUFFLER

[76] Inventors: Lars Collin, Vasterbergsgatan 3, Molndal, Sweden, 43139; Henrik Landalv, Attehogsgatan 10a, Goteborg, Sweden, 41674

[21] Appl. No.: 822,907

[22] Filed: Aug. 8, 1977

[30] Foreign Application Priority Data

Aug. 19, 1976 [SE] Sweden ..... 7609215

[51] Int. Cl.[2] ..... F01N 1/08; F01N 3/06

[52] U.S. Cl. ..... 181/250; 181/252; 181/255; 181/256; 181/266; 181/273

[58] Field of Search ..... 181/247, 248, 251, 264, 181/270, 272, 249–250, 252, 255, 256, 265, 266, 269, 273, 286

[56] References Cited

U.S. PATENT DOCUMENTS

| | | | |
|---|---|---|---|
| 2,009,343 | 7/1935 | Peik | 181/265 |
| 2,331,325 | 10/1943 | Jensen | 181/251 X |
| 2,331,344 | 10/1943 | Powers | 181/251 X |
| 2,332,543 | 10/1943 | Wilson | 181/251 |
| 2,740,616 | 4/1956 | Walden | 181/264 X |
| 3,353,628 | 11/1967 | Gilbert | 181/265 |
| 4,055,231 | 10/1977 | Martinez | 181/264 |
| 4,125,171 | 11/1978 | Morris | 181/265 |

*Primary Examiner*—Robert Louis Spruill
*Assistant Examiner*—W. D. Bray
*Attorney, Agent, or Firm*—Cantor and Singer

[57] ABSTRACT

For dampening exhaust gas noise a muffler contains two portions, of which one is adapted to take care of high frequency noise and includes dampening material, and the other is adapted to take care of low frequency noise and is devoid of such material. The latter portion includes an inner, perforated tube, a surrounding casing and wall means for subdividing the casing axially as well as transversely. The length of the tube is compatible with the lowest frequency of the noise to be divided, and the location of the wall means is selected as to form chambers of varying lengths compatible with other frequencies within the low frequency zone.

The high frequency portion may be fitted concentrically around the low frequency portion, or may be located so as to form an axial extention thereby.

The means communicating the low and the high frequency portions may include a radial diffusor.

16 Claims, 13 Drawing Figures

EXHAUST GAS MUFFLER

BACKGROUND OF THE INVENTION

The present invention refers to an exhaust muffler to be used in connection with internal combustion engines. The exhaust noise is composed of a number of different frequencies and corresponding wave-lengths. In order to obtain an efficient dampening of the noise it is customary to design one portion of the muffler mainly to take care of the frequency zone > 1000 Hz and a second portion to take care of the zone < 1000 Hz. The border line between these two zones is not a fixed one, but will be lower with increasing muffler size, and vice versa. It is evident that the operating domains of the two muffler portions will have to overlap, so an acceptable dampening within all frequency intervals is obtainable.

The dampening action within the low-frequency portion is mainly reactive (reflection). An analysis of this function is most easily obtained by considering a pure expansion chamber, which is the basic concept from the acoustic point of view.

An expansion chamber includes an enlargement of the cross sectional area along part of the flow tube, the area relationship chamber/tube determining the maximum dampening, and the length of the chamber determining the frequencies to be dampened according to the well-known relationship $L=(v/4f)$ where L is the length of the chamber, v is the velocity of sound, and f is the frequency (See U.S. Pat. No. 2,332,543). The basic concept of the simple expansion chamber may be augmented in different ways, so a dampening within a broad field of frequencies is obtainable.

By conducting the gasses through a tube having outwardly tapering perforations within the chamber, the resistance to flow may be considerably reduced. The outwardly directed cones have two primary objects.

(1) The resistance to flow will be reduced compared with the conventional bores, as the flowing gases to a large extent will be retained in the tube, and do not flow through the chamber.

(2) The generation of noise due to the perforations is eliminated. With a conventional perforation as oscillation of a certain frequency is often stabilized, the parameters being the velocity of flow and the axial distance between extension of the bores. Tests have shown that this phenomenon may result in an increase of the exhaust noise amounting to 5–10 dB.

By locating the perforations along part of the axial extension of the tube it is possible to achieve the advantages of a tubular resonator. Such a resonator is, in the conventional concept, an expansion chamber, where the tube has been extended into either or both ends of the expansion chamber.

By dividing an expansion chamber in two or more axially spaced compartments, which each will communicate individually with the tube by way of perforations, it is possible to tune the muffler exactly to selected frequencies. The perforations are then located at certain portions of the axial extension of the tube, and preferably, to some extent, differently at different spaces.

By dividing one or more of the spaces into two or more compartments by means of transverse walls the tuning possibilities are further increased.

By locating the transverse walls at suitable positions it is possible, in combination with suitably distributed perforations at the tube, to obtain a satisfactory dampening at frequencies corresponding to the total length of expansion chamber, as well as with the pass band obtainable with a muffler of conventional design.

The dampening function of the high frequency portion is mainly resistive (absorption).

An absorption muffler usually includes an expansion chamber through which a perforated tube is extended, and where the volume of the chamber to a large extent is filled with absorbing material. In order to increase the useful life of this material, this may be reinforced by a stretched - metal sheet, and/or be retained at some distance from the perforated tube by means of a wire mesh. A further increase of the useful life is obtained if the perforations are formed as tapering projections which will largely eliminate the influence of the gas flow upon the absorbing material.

The frequency interval (wave length interval) which may be dampened with an absorption muffler of this type is determined by the thickness of the layer of absorbing material (lower frequency limit) and the radial distance to the dampening material (upper frequency limit). For a given frequency the dampening is directly proportional to the axial extension of the dampening zone.

SUMMARY OF THE INVENTION

The invention is primarily concerned with the low frequency portion of a muffler and includes a tube being perforated along at least one part of its axial extension and a surrounding casing forming dampening chamber means communicating with the tube and being devoid of dampening material.

The invention is characterized in that the chamber means by axial partition walls is subdivided into at least two mutually separate spaces and that at least one of these spaces by at least one transverse wall is subdivided into separate compartments. The perforations in the tube generally do not cover the full circumference of the tube, but vary from compartment to compartment, in such a manner that the individual compartments will be tuned to different frequency zones and furthermore the lowest frequencies, corresponding to essentially the full length of the muffler will, thus, be taken care of.

According to a development of the invention the low frequency portion is combined with a high frequency portion according to any of the alternatives to be described herebelow. The invention is then characterized in that the casing is enclosed in a housing, an inlet to and an outlet from the muffler being provided at one axial end of the housing, the end of the inner tube remote from the inlet being connected to a return chamber, which merges into a return flow passage, concentric with the casing. The high frequency portion may be located in different ways along the concentric return flow passage. The space available for mounting the muffler, and the point of the exhaust pipe at which the muffler is to be fitted, will determine which combination is the preferable one for a given occasion.

The high frequency portion may be fitted concentrically with respect to the low frequency portion, but it may also form an axial extension thereof.

The merging of the low frequency portion into the high frequency portion is preferably formed as a radial diffusor.

The cross sectional area will, with a concentric arrangement, be acoustically advantageous for dampening high frequencies, as the distance to the absorbent will be noticeably reduced, usually to about one third of that with a conventional arrangement, which will raise the upper dampening limit correspondingly, on this occasion with a factor about equal to 3.

As turbocharging of the engines, with correspondingly raised noise levels within the higher frequencies, will become more and more common, this raising of the frequency limit will be very favourable.

In order to obtain an optimal distribution of the pressure drop within the muffler the cross sectional area of the high frequency portion will be larger than that of low frequency portion. The reason is that the boundary surface is bigger at the high frequency portion.

With respect to space requirement the different combinations of the low and the high frequency portions represent alternatives varying from a compact body of short length, but having a big diameter, to an elongate shape. Common for most of them is that inlet and outlet are located at the same end of the muffler, the outlet being fitted either in the shell plate or in an end plate. The muffler may thus be fitted as an "appendix" to the exhaust pipe which permits mounting in an unconventional manner, for instance in a pocket in the chassis of a vehicle. Also with the compact embodiment (having the absorbent concentrically inside the shell) such a mounting is possible, on occasions when temperature restriction would otherwise require a heat insulation in conventional types of mufflers.

The radial diffusor connecting the low and the high frequency portions will aid in the dampening within the low frequency and the infrasound frequencies (infra sound $< 20$ Hz). As the environmental influence of lower frequencies are now more closely observed the dampening action of the radial diffusor is valuable.

DESCRIPTIONS OF SOME PREFERRED EMBODIMENTS

Figure 1:
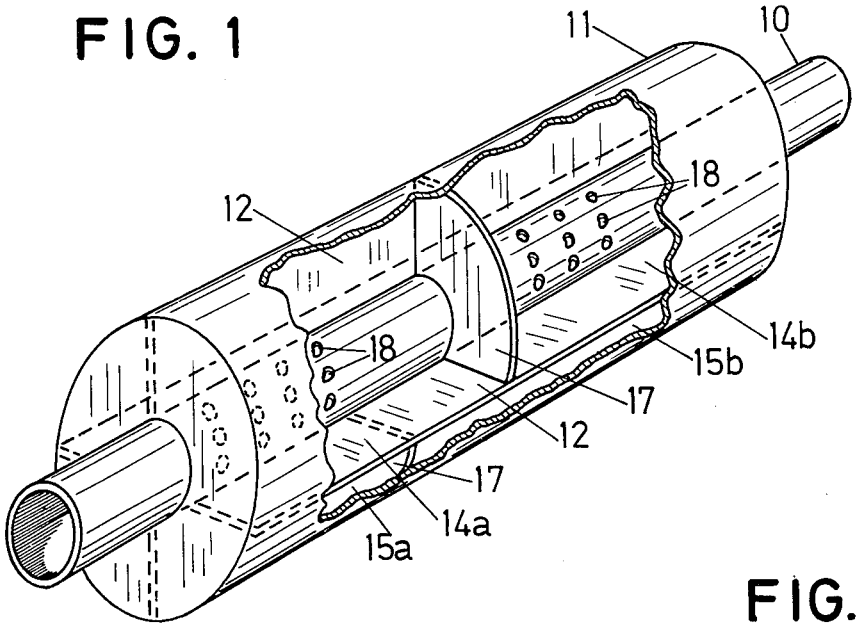
FIG. 1 schematically shows a perspective view of the low frequency portion of a muffler.
Figure 2:
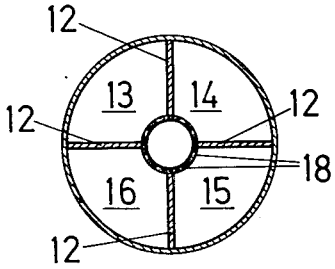
FIG. 2 shows a cross section through the same.
Figure 3:
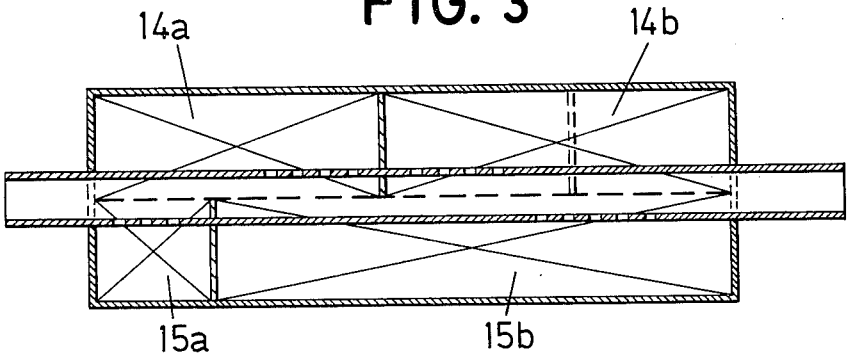
FIG. 3 shows a longitudinal section on a somewhat reduced scale.

The low frequency portion shown in FIGS. 1–3 includes a tube 10 connectable in any suitable manner to the exhaust pipe from an internal combustion engine, as well as a casing 11 enclosing the tube. The casing does not contain any dampening material, but forms a reflection dampening chamber. This chamber is, by means of axially running partition walls 12, subdivided into a number of spaces, which in FIG. 2 are marked 13–16. The partition walls are here symmetrically arranged, but it is also possible to locate the partition walls so differently sized cross sectional areas are obtained in the spaces. Some of these spaces are further subdivided into compartments by means of transverse walls 17. The location of these transverse walls will determine the volume of the individual compartments. In FIGS. 1 and 3 it is thus intimated that compartments **14*a* and 14*b* have about the same volume, whereas 15*a* only extends along about one fourth of the total length, and compartment 15*b*** extends over the remainder thereof.

Tube 10 is perforated so it communicates with each compartment. By selecting the total area of the perforations, as well as the location thereof, so the opening will extend over part of the axial extension of the pertaining compartment, possibilities for an exact tuning to various frequencies is obtainable.

The openings 18 are, in a manner known per se, surrounded by truncated cones, directed away from the tube. As mentioned above, the resistance to flow, as well as the risk of secondary noise phenomena, will hereby be reduced.

The perforations, in the low frequency portion, as well as in the following high frequency portion are preferably arranged in a triangular pattern, as this will permit the highest degree of perforation (with circular openings) and furthermore provides the best surface with respect to the gas flow, even if the highest degree of perforation is not utilized. In order to obtain the biggest axial distance between the openings the basis of the triangle is located transversely with respect to the axial direction of the tube. This conical shape has proven efficient, even if the degree of perforation amounts to 40%. A degree of perforation about equal to 30–35% may be used in the low frequency as well as in the high frequency portion, the height of the conus then being about one half of the diameter of the opening, and the angle at the apex being 45–60 degrees.

A low frequency portion of the type above described may be combined with a high frequency portion of arbitrary form and having any suitable location, but according to the invention the high frequency portion is preferably located so it encloses the low frequency portion. The muffler shown in FIGS. 4 and 5 includes a low frequency portion, as well as a high frequency portion. The first mentioned one is of principially the same design as that described in connection with FIGS. 1–3, but the tube 10 is terminated by a radial diffusor 20, forming a return chamber, directing the gases into the high frequency portion. This is outwardly defined by a shell plate 21 and is partly filled with dampening material 22. This is retained in its proper position by means of a wire mesh 23.

A return flow passage 24 surrounding the low frequency portion is inwardly defined by the casing thereof, and outwardly by a perforated plate 25. The perforations in this plate are referably also of the conical type.

The arrangement is selected so the cross sectional area of the return flow passage will be 40 to 50% bigger than that of the tube 10, in order to compensate for the friction along the larger contact areas. Wire meash 23 is fitted in such a manner that a free space is formed just outside the perforated plate 25. The radial distance between wire mesh 23 and plate 25 is one of the parameters determining the high frequency dampening, and will thus be adapted to the dampening requirements.

The outlet 26 from the muffler is here directed radially outwards adjacent to the inlet connection at tube 10.

The radial diffusor 20 is inwardly defined by the half shell 27 of a toroid, and is outwardly defined by the quarter-shell 28 of a toroid, and a central abutment plate 29.

As indicated by dotted lines at 30, this abutment plate may be wholly or partly substituted by a conical member, the generating line of which is selected so the flow area will remain substantially constant during the first 90° of the deflection of the gases, and thereafter permits an expansion.

The return flow passage 24 is preferably subdivided into a number of parallel ducts by means of guide walls 31. As the outlet 26 is directed radially outwards, and the axial flow of the gases will have to be deflected by 90°, it is advantageous, by bending the guide walls 31 adjacent to the outlet, to direct the flow within the ducts towards the outlet.

Figure 7:
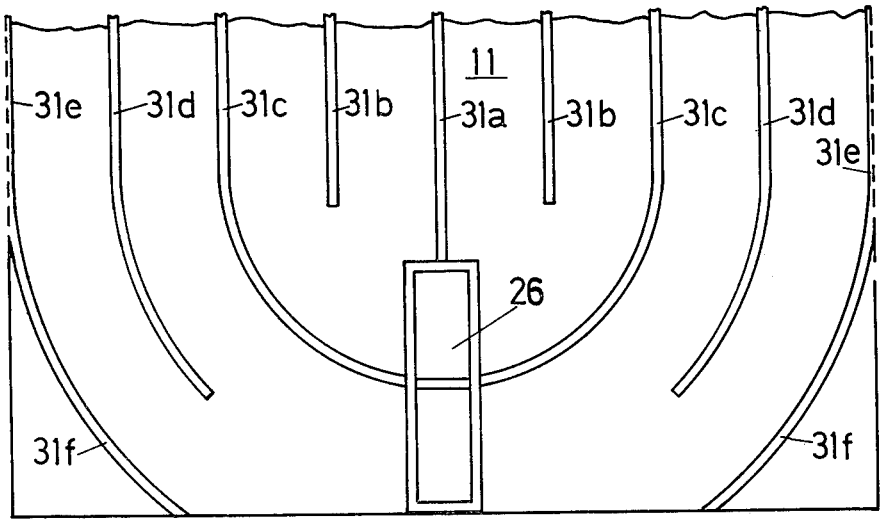
FIG. 7 shows schematically, a fold-out picture of the shell plate adjacent to the outlet.

FIG. 7 shows a fold-out picture of the casing wall 11 adjacent to the outlet. Outlet 26 has a rectangular cross section, and is subdivided into two passages by means of an internal wall. The uppermost guide wall 31*a* is directed straight into the outlet, and the two adjacent guide walls 31*b* are likewise straight, but are terminated at a distance from the outlet. The horizontally located guide walls 31*c* are bent towards the side walls of the outlet conduit, and the lower, sideward guide walls 31*d* are likewise bent towards outlet 26, but are terminated at a distance from the same. The lowermost guide wall 31*e* runs straight for a substantial part of its extension, but is, adjacent to the outlet, continued by two bent baffle plates 31*f*.

In order to avoid pressure drop losses at the outlet caused by the reduced flow area due to the bent shape of the guide walls, the distance between the perforated plate 25 and the casing 11 should be increased, so the cross sectional area remains substantially constant.

In a modified embodiment the guide walls 31 may be wound helically around the casing, along a substantial part of the return flow conduit, from the radial diffusor 20 towards the outlet 26.

The embodiment above described permits a very compact design, and will be used when there is space available in the radial direction, or when it is desirable to reduce the axial length of the muffler.

Figure 8:
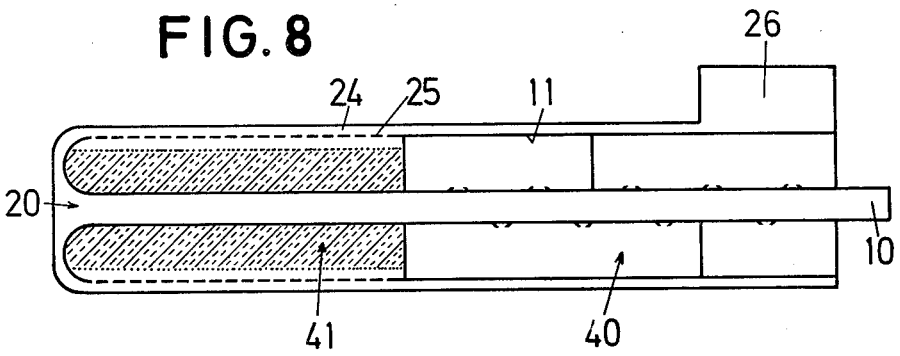
FIGS. 8–11 shows different locations of the high frequency portion in relation to the low frequency portion.
Figure 9:
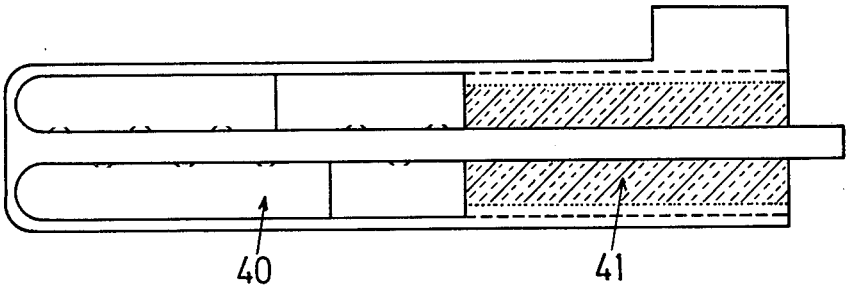

FIGS. 8 and 9 show two alternative arrangements, where the high frequency portion is located between the low frequency portion and the radial diffusor, and between the low frequency portion and the outlet, respectively.

As in the previously described figures the perforated inlet tube is denoted by 10, the radial diffusor by 20, the return flow passage by 24 and the outlet by 26. The perforated plate, which partly defines the high frequency portion, is denoted by 25, and here forms an extension of the outer shell of the casing 11 enclosing the low frequency portion. In order to simplify an identification of the two portions, which may have varying shapes in order to meet different dampening requirements, the low frequency portion is denoted by 40, and the high frequency portion by 41.

Figure 10:
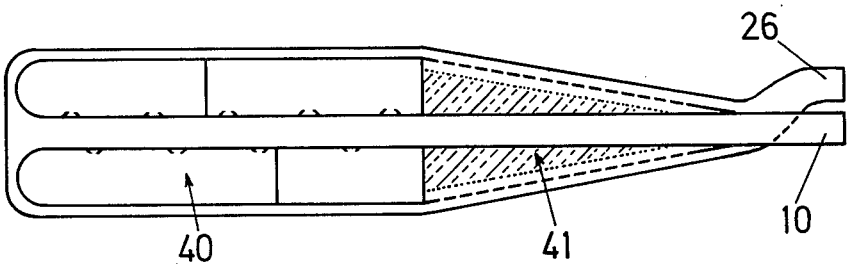
Figure 11:
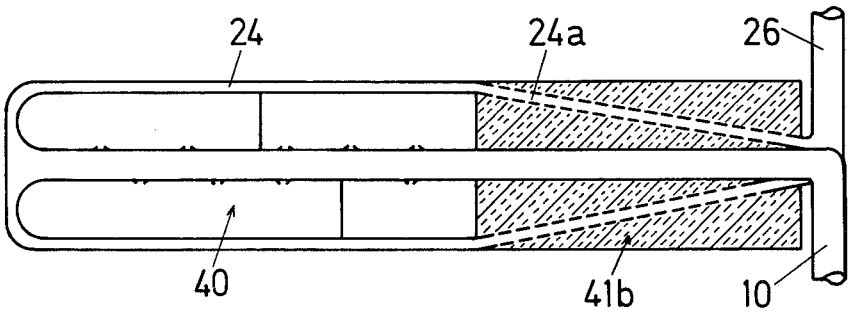

Depending upon the requirements and available mounting space the muffler according to FIG. 9 may be modified somewhat, as indicated in FIGS. 10 and 11. In FIG. 10 the high frequency portion 41*a* tapers in the direction of outlet 26. The inlet is axially directed but may be bent outside the muffler, so inlet and outlet will point mainly in opposite directions.

According to FIG. 11 the high frequency portion 41*b* is outwardly defined by an extension of the unperforated shell plate which encloses the return flow passage 24. This passage is, within the high frequency portion continued by an annular passage 24*a*, defined by tapering conical walls, which thus to both sides is surrounded by dampening material. The inlet 10 and the outlet 26 are concentric just outside the end plate of the muffler.

Figure 12:
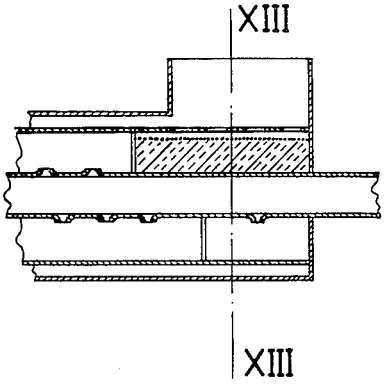
FIG. 12 shows an end portion of a muffler according to a modified embodiment and FIG. 13 shows a cross section along line XIII—XIII in FIG. 12.
Figure 13:
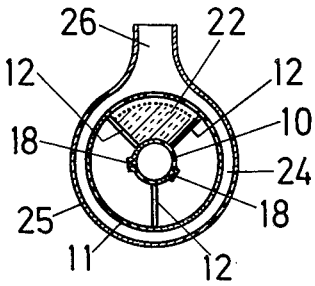

As is shown in FIGS. 12 and 13 it is not necessary that the low frequency portion occupies the full cross sectional area within casing 11 in the full axial extent thereof.

Figure 4:
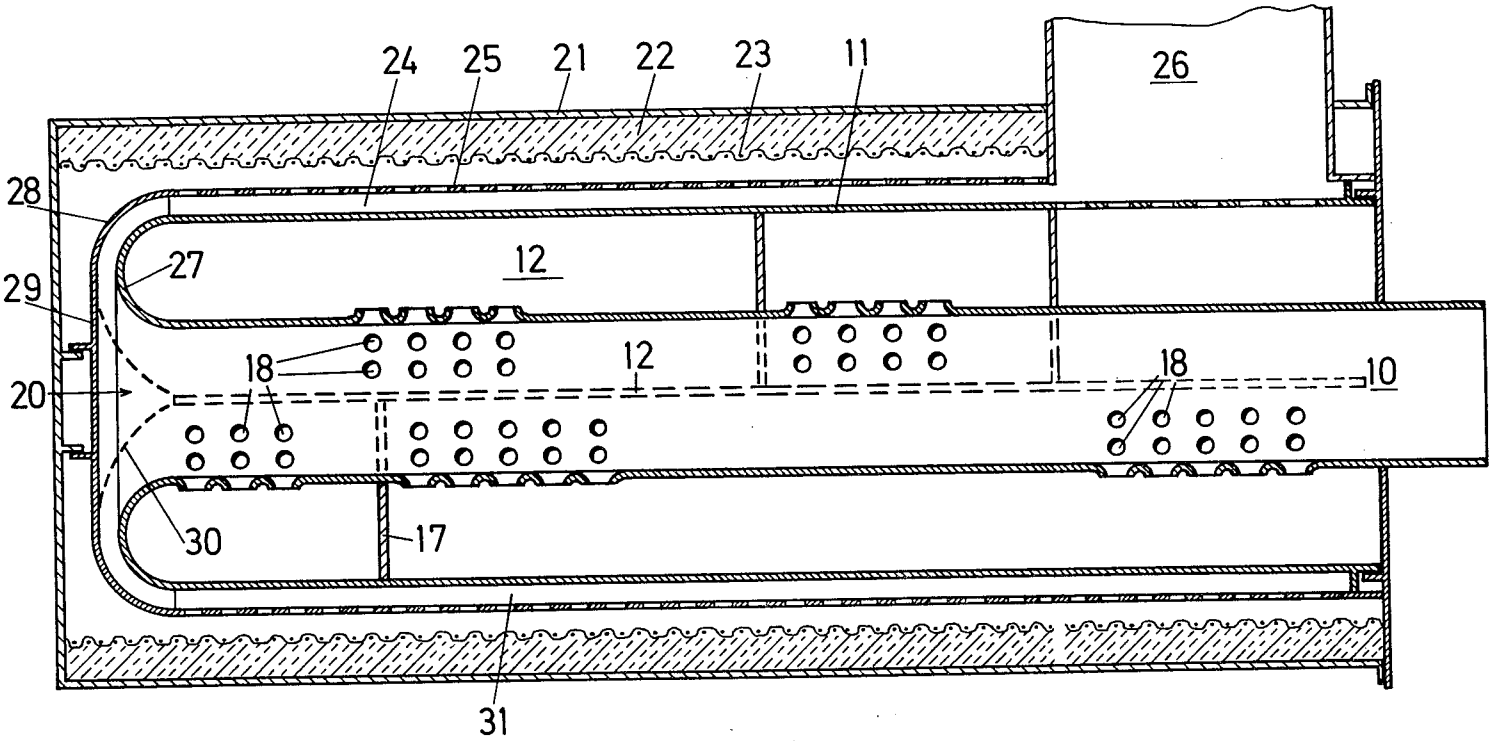
FIG. 4 shows an embodiment of a muffler including a low frequency and a high frequency portion.
Figure 5:
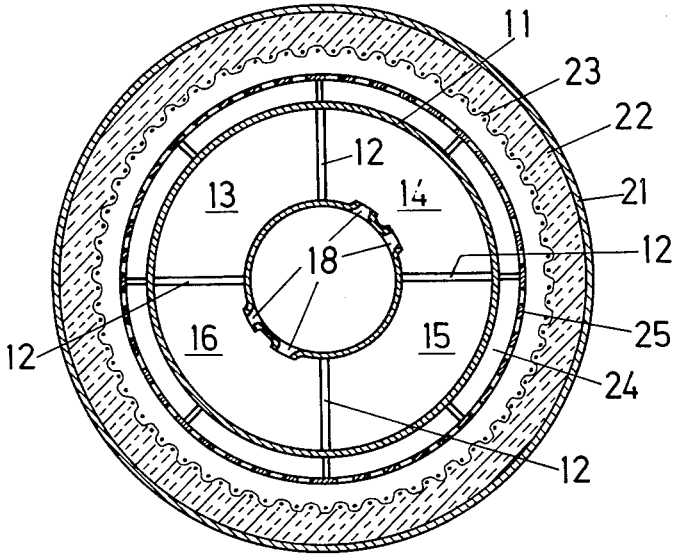
FIG. 5 shows a cross section through the same.
Figure 6:
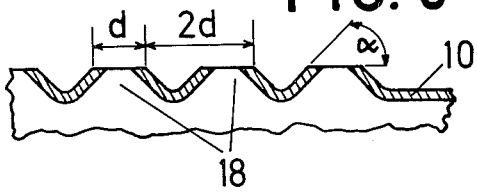
FIG. 6 shows, on a larger scale, a portion of the inner flow tube.

Along one, or a few compartments the casing 11 may be perforated, the corresponding part of the inner tube 10 being then devoid of perforations. The pertaining compartment 41*c*, or possible compartments used in the same manner, are then partly filled with dampening material 22 in the manner above described. This arrangement may for instance be combined with a high frequency portion as shown in FIG. 4, or FIGS. 8 and 9, respectively.

The embodiments above described are to be regarded as examples only, explaining a dampening principle which has proven satisfactory when reduced to praxis, and in which a number of parallel dampening chambers formed as full sectors, or axial portions thereof, cut out of the surrounding cylindrical volume, may be tuned for dampening different frequencies and varying intensities, in such a manner that the remaining noise level will not show any marked peaks. The application of this principle may be applied in other ways than those shown.

What we claim are:

1. In a muffler for dampening exhaust noise composed of sound waves having various frequencies:

an axially extending tube adapted to be connected to an exhaust pipe, a casing surrounding said tube, and being devoid of dampening material, first axial wall means extending longitudinally of said tube to subdivide said casing into at least two mutually separate spaces, second transverse wall means extending radially from said tube to subdivide at least one of said spaces into at least two mutually separate chambers, and openings in the wall of said tube for individually communicating the interior of said tube with said at least one sub-divided space and said two chambers, the openings communicating said tube with said at least one sub-divided space being located along part of the axial extension of said tube, to form said space into a resonator compatible with the lowest frequency to be dampened.

2. In an exhaust gas muffler a first portion including an inner, perforated tube attachable to an exhaust pipe, a casing devoid of dampening material, enclosing said inner tube and wall means subdividing said casing axially as well as transversely into a number of separate chambers, a second portion including dampening material, a common outer housing defined by a shell plate and two end plates enclosing said first and said second portions, an inlet to and an outlet from said muffler located at one of said end plates, and an internal return chamber for conducting gas from said first portion to said second portion.

3. The muffler according to claim 2, in which the return chamber means is formed as a radial diffusor.

4. The muffler according to claim 3, in which said radial diffusor is inwardly defined by the half shell of a toroid body and outwardly by an outer-quarter shell of a toroid body combined with an abutment plate.

5. The muffler according to claim 4, in which said abutment plate, at least partly, is formed as a conical shell, the generating line of which is selected so as to maintain a substantially constant cross sectional area during the first 90° of the deflection of the gas pass, and thereafter causes an expansion of the area.

6. The muffler according to claim 2, in which said second portion is located concentrically around said first portion, said return chamber means communicating with a return flow passage, being inwardly defined by the casing of said first portion.

7. The muffler according to claim 6, in which the cross sectional area of said return passage is at least 50% bigger than that of said inner tube.

8. The muffler according to claim 6 further including a perforated plate, outwardly defining said return passage.

9. The muffler according to claim 8, in which said perforated plate is provided with outwardly tapering perforations.

10. The muffler according to claim 8 further including a wire mesh concentrically arranged with respect to said perforated plate for maintaining the dampening material of said second portion at a distance from said perforated plate.

11. The muffler according to claim 8 further including guide walls for subdividing said return passage into a number of parallel ducts.

12. The muffler according to claim 11 having an outlet connected radially to its shell, in which said guide walls, adjacent to said outlet are bent in relation to the longitudinal axis of the casing, the cross sectional areas within said ducts being maintained substantially uniform by an increase of the radial distance between said casing and said perforated plate.

13. The muffler according to claim 2, comprising a first low frequency dampening portion and a second high frequency dampening portion arranged axially with respect to each other, and having substantially the same cross sectional area, and having said inlet and said outlet arranged concentrically in one of said end plates.

14. The muffler according to claim 13, in which the second portion, as well as the surrounding part of the return flow passage tapers in the direction towards said outlet.

15. The muffler according to claim 13, in which the return flow passage extends through said second portion and within said second portion tapers in the direction towards said outlet.

16. In an exhaust gas muffler a first portion including an inner part perforated tube attachable to an exhaust pipe, a casing enclosing said inner tube and wall means subdividing said casing axially as well as transversely into a number of separate chambers, a second portion forming an annular chamber surrounding the first portion, a common outer housing defined by a shell plate and two end plates enclosing said first and said second portions, an inlet to said first portion axially connected to one of said end plates and an outlet from said second portion directed radially outwards from said shell adjacent to said one end plate, means for mounting dampening material within said second portion and within at least one of the chambers in said first portion located outside of an unperforated part of said inner tube, openings in said inner tube for communicating the interior of said inner tube with those compartments in said first portion being devoid of dampening material and further openings in said casing for communicating said second portions with said at least one chamber in said first portion supplied with dampening material.

* * * * *